United States Patent [19]

Honma et al.

[11] Patent Number: 4,871,407

[45] Date of Patent: Oct. 3, 1989

[54] IMAGE RECORDING MATERIAL CAPABLE OF FORMING THREE-DIMENSIONAL IMAGES

[75] Inventors: Shigeo Honma; Kazuyoshi Hara, both of Osaka, Japan

[73] Assignee: Minolta Camera Kabushiki Kaisha, Osaka, Japan

[21] Appl. No.: 222,816

[22] Filed: Jul. 21, 1988

[30] Foreign Application Priority Data

Jul. 29, 1987 [JP] Japan ..... 62-115123[U]

[51] Int. Cl.[4] ..... B41M 5/00

[52] U.S. Cl. ..... 156/83; 156/219; 156/234; 156/235; 156/240; 156/241; 156/277; 428/195; 428/209; 428/211; 428/321.5; 428/377; 428/500; 428/521; 428/522; 428/913; 428/914; 428/537.1; 428/40

[58] Field of Search ..... 428/195, 321.5, 913, 428/914, 209, 211, 327, 500, 521, 522, 537.1, 40; 156/83, 219, 234, 235, 240, 241, 277

[56] References Cited

U.S. PATENT DOCUMENTS 3,088,402 5/1963 Newman ..... 156/83
4,006,267 2/1977 Kurz et al. ..... 427/156

FOREIGN PATENT DOCUMENTS 55-101954 3/1976 Japan ..... 156/83
56-92544 9/1977 Japan ..... 156/83
59-35359 7/1981 Japan ..... 156/83

*Primary Examiner*—Ellis P. Robinson
*Assistant Examiner*—P. R. Schwartz
*Attorney, Agent, or Firm*—Burns, Doane, Swecker & Mathis

[57] ABSTRACT

A sheet-like image recording material capable of forming a three-dimensional image. The image recording material comprises a sheet-like base material, a thermoexpansive coating layer formed by applying thermoexpansive microspheres onto the base material surface together with a binder, the thermoexpansive spheres being each formed by encapsulating a low boiling, vaporizable substance into a microcapsule of an thermoplastic resin, and a film layer bonded releasably onto the surface of the coating layer or the base material surface on the side where the coating layer is not provided. A toner image of a desired original image is formed on the film layer according to a electrophotographic method and then irradiated with light, whereby the toner image portion is heated selectively, so that the thermoexpansive layer expands to raise the image, thus affording a three-dimensional image. The toner image can be removed by peeling the film layer from the sheet-like image recording material.

18 Claims, 4 Drawing Sheets

IMAGE RECORDING MATERIAL CAPABLE OF FORMING THREE-DIMENSIONAL IMAGES

BACKGROUND OF THE INVENTION

The present invention relates to an image recording material capable of forming three-dimensional images raised from sheet.

For forming images having cubic effect on sheet there have widely been used physical methods such as, for example, pressing sheet using a matrix. In addition, there has recently been adopted a method using a thermoexpansive sheet P which, as shown in sectional construction in FIG. 1, comprises a base sheet 1 and a coating layer 2 formed thereon, the coating layer 2 containing thermoexpansive microspheres 3 of a low boiling, vaporizable material each encapsulated in a thermoplastic resin microcapsule (see Japanese Examined Patent Publication No. 35359/84 and Japanese Laid-Open Patent Publication No. 101954/80).

For forming a three-dimensional image using the aforesaid thermoexpansive sheet, first a desired image is formed on the sheet using a material superior in light absorbing characteristic. For example, the image is formed with black toner using a conventional electrophotographic type copying machine. FIG. 2 (*a*) shows a state wherein images 4 have been formed with black toner on the coating layer 2 of the thermoexpansive sheet P. Then the surface of the sheet P is irradiated with light, with the result that only the image portions 4 formed with black toner are heated selectively due to the difference in light absorbing characteristic, thereby causing the thermoexpansive microspheres 3 to expand. Consequently, the image portions are raised from the sheet surface to form images having cubic effect as shown in FIG. 2 (*b*).

After formation of such three-dimensional images according to the above conventional method there remains toner images of black or any other deep color on the coating layer of the thermoexpansive sheet. Formation of such toner images is inevitable in the course of making images three-dimensional, but after completion of the three-dimensional image formation, the presence of such toner images is an obstacle when the image surfaces are to be colored. In the use as a braille sheet, moreover, the toner in a molten condition is likely to fall off the sheet during repeated touching and reading and stain fingers.

SUMMARY OF THE INVENTION

It is a principal object of the present invention to provide a novel image recording material for the formation of three-dimensional images which is capable of being colored in any desired color.

It is another object of the present invention to provide a novel image recording material for the formation of three-dimensional images, capable of removing toner images used in the formation of three-dimensional images.

The above and other objects and features of the invention will appear more fully hereinafter from a consideration of the following description taken in connection with the accompanying drawing wherein one example is illustrated by way of example.

DETAILED DESCRIPTION OF THE PREFERRED EMBODIMENTS

The present invention relates to an image recording material for the formation of three-dimensional images suitable for use in a three-dimensional image forming method wherein an image if formed on the recording material using toner according to an electrophotographic method and heat is applied selectively to the image area formed by the toner to raise the image area, said image recording material comprising:

a sheet-like base material;

a thermoexpansive coating layer formed by application on the base material, the coating layer containing microspheres constructed to expand upon application of heat and a binder for bonding to the base material in a dispersed condition of the microspheres in the coating; and a film layer releasably attached to an outer surface of the recording material and permitting the formation of a toner image thereon according to an electrophotographic method, whereby the toner image can be removed by peeling the film after the image area has been raised by the application of heat.

Embodiments of the present invention will be described hereinunder.

Figure 1:
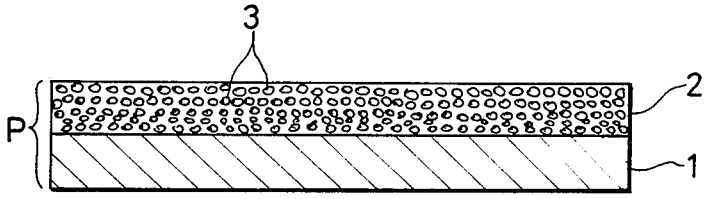
FIG.1 PRIOR ART
FIG. 1 is an enlarged sectional view showing the construction of a conventional thermoexpansive sheet.
Figure 2A:
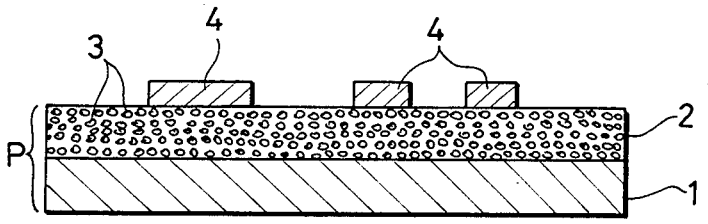
FIG.2(a) PRIOR ART
FIGS. 2 (*a*) and (*b*) are explanatory views of three-dimensional image forming steps using the conventional thermoexpansive sheet shown in FIG. 1.
Figure 2B:
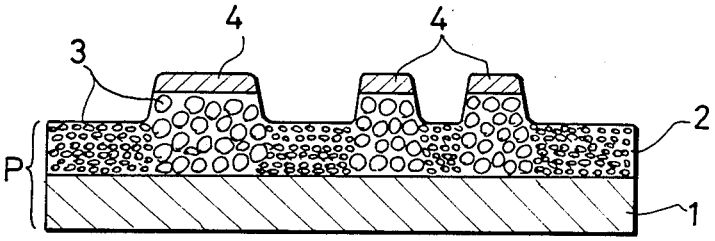
FIG.2(b) PRIOR ART
Figure 3:
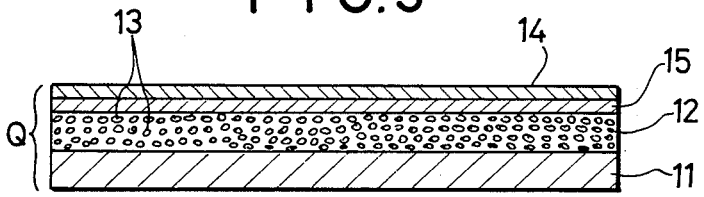
FIG. 3 is an enlarged sectional view showing the construction of an image recording material according to a first embodiment of the present invention.

FIG. 3 is a sectional view explanatory of the construction of an image recording material Q according to a first embodiment of the present invention, in which the thickness of each layer is shown on a larger scale. In the same figure, the reference 11 denotes a base sheet formed of a material having rigidity enough to prevent expansion of the back side of the base sheet when later-described thermoexpansive microspheres expand on heating, and which material does not soften at a temperature at which the said microspheres expand. Examples of such material include paper, synthetic paper, synthetic resin sheet, plywood and metal foil.

Numeral 12 denotes a coating layer formed by applying thermoexpansive microspheres 13 of 5 to 30$\mu$ in particle diameter onto the base sheet 11 together with a binder of a thermoplastic resin such as, for example, vinyl acetate resin, acrylic acid ester resin, methacrylic acid ester resin, or styrene-butadiene resin, followed by drying. The thermoexpansive microspheres 13 are each formed by encapsulating propane, butane or any other low boiling, vaporizable substance into a microcapsule of a thermoplastic resin such as vinylidene-chloride-acrylonitrile copolymer, methacrylic acid ester-acrylonitrile copolymer, or vinylidene chloride-acrylic acid ester copolymer. As the thermoexpansive microshpere there also may be used a granular, heat-sensitive, organic foaming agent such as azobisisobutyronitrile.

Numeral 14 denotes a releasable film formed of a material which permits fixation of toner image thereto, e.g. synthetic resin film, paper, or synthetic paper, with an adhesive layer 15 provided on the back of the film 14 to stick the film onto the coating layer 12 releasably. The adhesive is required to be chemically stable with respect to the material of the coating layer, have heat resistance high enough to resist heat when toner is fixed, be adhesive to the extent that it does not remain on the surface of the coating layer 12 nor does it roughen the said surface when the film 14 is separated from the coating layer 12, and be superior in heat conduction. There may be used conventional adhesives such as vinyl acetate- or acrylic acid-based adhesives.

Three-dimensional images are formed in the following manner.

Figure 4A:
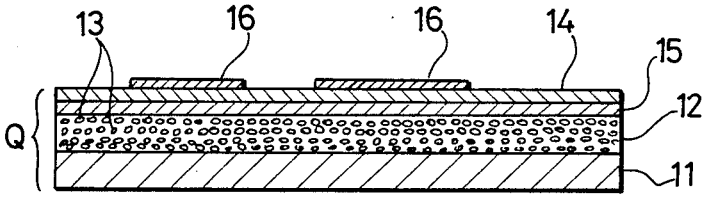
FIGS. 4 (*a*), (*b*) and (*c*) are explanatory views of three-dimensional image forming steps using the image recording material shown in FIG. 3.
Figure 4B:
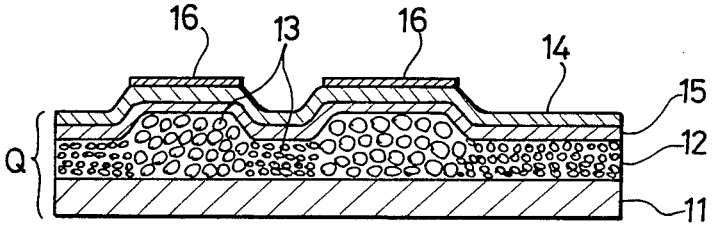
Figure 4C:
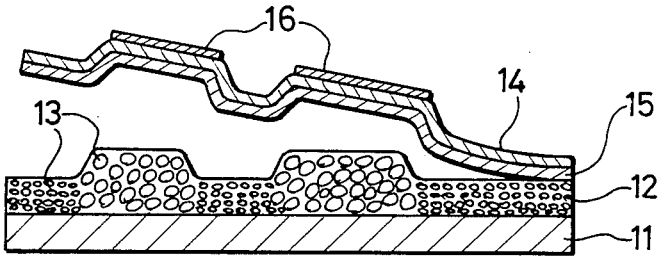

First, original images are copied onto the releasable film 14 of the image recording material Q (hereinafter referred to as the "sheet Q") using black toner by means of a conventional electrophotographic type copying machine. FIG. 4 (*a*) shows a section of the sheet Q with toner images 16 formed thereon.

Figure 5:
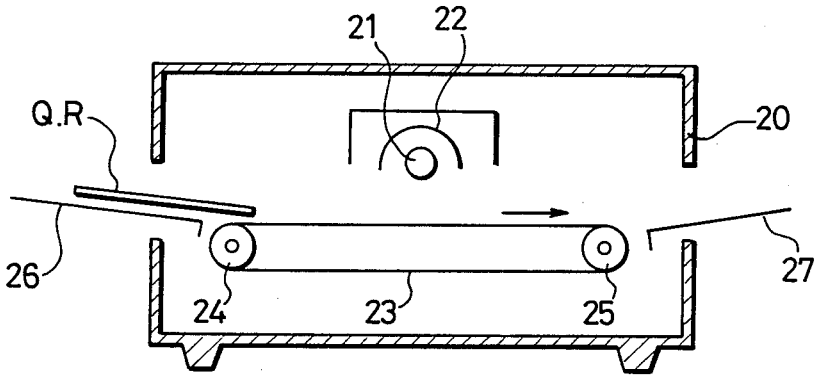
FIG. 5 is a sectional view showing a main construction of a light irradiator.

Next, the sheet is irradiated with light. An example of a light irradiator is shown in FIG. 5. In a housing 20 there is provided an illuminant lamp 21 such as a halogen lamp in an upper position below a reflecting mirror 22. Below the illuminant lamp 21 there is disposed a conveyor belt 23 formed of a metal or any other heat-resistant material, which is stretched between a driving pulley 24 and a driven pulley 25 and is moved in the direction of arrow by means of a drive source (not shown). Numerals 26 and 27 denote a paper feed tray and a paper discharge tray, respectively.

The conveyor belt 23 is started to move by applying power and the illuminant lamp 21 is turned ON. Then, the sheet Q is advanced so that the releasable film 14 with the toner images 16 formed thereon is opposed to the lamp 21. The sheet Q is irradiated with light under the illuminant lamp 21, whereupon the images 16 formed by black toner absorb light energy and are heated thereby, so that the coating layer 12 underlying the toner images 16 is heated through the releasable film 14. As a result, the microspheres 13 in this area expand rapidly to raise the corresponding portions of the coating layer 13. FIG. 4 (*b*) shows the section of the sheet Q after completion of the irradiation.

Next, the releasable film 14 is separated, leaving toner image-free, three-dimensional images on the surface of the coating layer, as shown in FIG. 4 (*c*).

Figure 6:
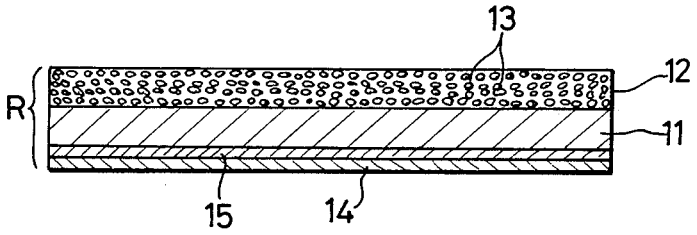
FIG. 6 is an enlarged sectional view showing the construction of an image recording material according to second embodiment of the present invention.

A second embodiment of the present invention is shown in FIG. 6, which is different from the first embodiment in that, as shown in the same figure, the releasable film 14 is provided on the back of the base sheet 11, that is, on the side opposite to the thermoexpansive coating layer 12.

Figure 7A:
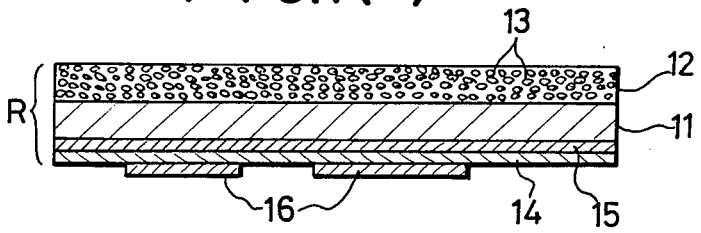
FIGS. 7 (*a*), (*b*) and (*c*) are explanatory views showing three-dimensional image forming steps using the image recording material shown in FIG. 6.
Figure 7B:
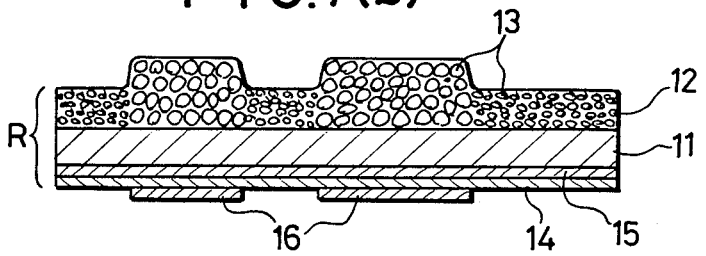
Figure 7C:
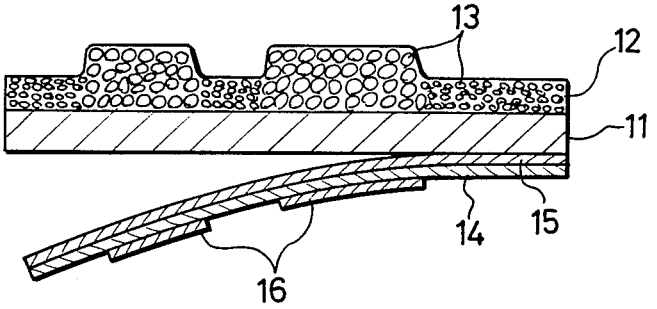

For forming three-dimensional images using this image recording material indicated by R (hereinafter referred to as the "sheet R"), original images are copied onto the releasable film 14 using an electrophotographic type copying machine, which original images are reversed right and left from proper images. FIG. 7 (*a*) shows the section of the sheet R with toner images 16 formed thereon.

Next, the sheet R is irradiated with light in the same way as in the first embodiment. At this time, the back of the sheet R, that is, the releasable film 14 with the toner images 16 formed thereon is opposed to the illuminant lamp 21. The images 16 formed by black toner absorb light energy and are heated thereby, so that the coating layer 12 overlying the images 16 is heated through the film 14 and the base sheet 11. As a result, the microspheres 13 in this area expand rapidly to raise the corresponding portions of the coating layer 12. FIG. 7 (*b*) shows the section of the sheet R after completion of the irradiation.

Then, by separating the releasable film 14 there can be obtained three-dimensional images free from toner images on the back of the sheet, as shown in FIG. 7 (*c*).

Figure 8:
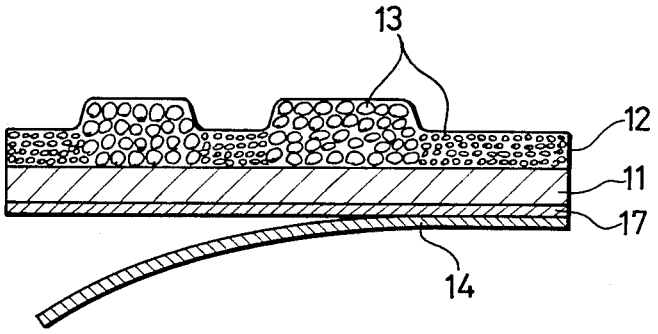
FIG. 8 is an enlarged sectional view showing the construction of an image recording material according to a third embodiment of the present invention.

According to a third embodiment of the present invention, as shown in FIG. 8, having a layer construction similar to that of the second embodiment shown in FIG. 6, a pressure-sensitive adhesive layer 17 is provided on the back of the base sheet 11 and a releasable sheet is sticked thereon so that upon removal of the releasable sheet the pressure-sensitive adhesive 17 remains on the back of the base sheet 11.

If the releasable sheet is removed after formation of three-dimensional images in accordance with the same process as in the second embodiment, the base sheet with three-dimensional images can be sticked onto a wall surface or any object through the pressure-sensitive adhesive on the back of the sheet. FIG. 8 shows the section of the sheet after formation of three-dimensional images on the base sheet of the third embodiment and after removable of the releasable sheet.

Although in all of the above embodiments the releasable film is sticked on either face of the image recording material, it may be sticked on both faces of the same material so that a desired face can be used selectively at the time of image formation.

According to the image recording material of the present invention, as set forth above, the toner images which have been used in the formation of three-dimensional images can be removed from the base sheet after formation of such three-dimensional images, so the surfaces of those three-dimensional images can be colored in desired colors. Moreover, in the case where the image recording material of the invention is used as a braille sheet, there is no fear of molten toner falling off the sheet with repeated touching for reading.

Having described a specific embodiment of our bearing, it is believed obvious that modification and variation of our invention is possible in light of the above teachings.

What is claimed is:

1. An image recording material for recording a toner-free, three-dimensional image suitable for use in a three-dimensional image forming method wherein a toner image of an original is formed on the recording material according to an electrophotographic method and heat is applied selectively to the image area formed by the toner to raise the image area, said image recording material comprising:

a sheet of base material;

a thermoexpansive coating layer formed by application on the base material, said thermoexpansive coating layer comprising thermoexpansive microspheres and a binder for bonding to the base material, said microspheres being dispersed in said binder; and a film layer releasably attached to an outer surface of said recording material, said film layer comprising a material which permits fixation of a toner image thereto and an adhesive layer which releasably bonds to said outer surface of said recording material, said film layer permitting the formation of a toner image thereon according to an electrophotographic method, whereby the toner image can be removed from said recording material by peeling said film layer from said recording material surface after the image area has been raised by the application of heat.

2. An image recording material according to claim 1, wherein said thermoexpansive microspheres are each formed by encapsulating a low boiling, vaporizable substance into a microcapsule of a thermoplastic synthetic resin, and wherein said binder comprises a thermoplastic synthetic resin as a principal component.

3. An image recording material according to claim 2, wherein said thermoplastic binder resin is a member selected from the group consisting of vinyl acetate, acrylic acid ester, methacrylic acid ester and styrene-butadiene.

4. An image recording material according to claim 2, wherein said vaporizable substance comprises propane or butane.

5. An image recording material according to claim 2, wherein said thermoplastic microcapsule resin is a member selected from the group consisting of vinylidene chloride-acrylonitrile copolymer, methacrylic acid ester-acrylonitrile copolymer and vinylidene chloride-acrylic acid ester copolymer.

6. An image recording material according to claim 1, wherein said film layer is releasably attached to said thermoexpansive coating layer surface opposite that of said base material.

7. An image recording material according to claim 6, wherein said image recording material further comprises a pressure-sensitive adhesive layer provided on the back of said base sheet and being releasably attached to a releasable sheet, whereupon the removal of the releasable sheet results in the pressure-sensitive adhesive remaining on the back of the base sheet.

8. An image recording material according to claim 1, wherein said film layer is releasably attached to said base material surface opposite that of said thermoexpansive coating layer.

9. An image recording material according to claim 1, wherein said base material is a member selected from the group consisting of paper, synthetic paper, synthetic resin sheet, plywood and metal foil.

10. An image recording material according to claim 1, wherein said thermoexpansive microspheres comprise a granular, heat-sensitive, organic foaming agent.

11. An image recording material according to claim 10, wherein said foaming agent comprises azobisisobutyronitrile.

12. An image recording material according to claim 1, wherein said thermoexpansive microspheres comprise a particle diameter of from 5 to 30 microns.

13. An image recording material according to claim 1, wherein said film layer material is a member selected from the group consisting of paper, synthetic paper and synthetic resin film.

14. An image recording material according to claim 1, wherein said film layer adhesive is vinyl acetate-based or acrylic acid-based.

15. An image processing method for forming a toner-free, three-dimensional image on a recording material, which method comprises the steps of:

providing a recording material, said recording material comprising a base material, a thermoexpansive coating layer provided on the base material, said thermoexpansive coating layer comprising thermoexpansive microspheres dispersed in a binder, and a film layer releasably attached to an outer surface of said recording material;

forming a toner image of an original on said film layer of said recording material;

applying heat selectively to the toner image area formed on said recording material, whereby the toner image-existing area is raised to effect a three-dimensional image recording; and peeling said film layer from the recording material, whereby the toner image is removed from said recording material surface and a toner-free, three-dimensional image is formed.

16. An image processing method according to claim 15, wherein said film layer is releasably attached to said thermoexpansive coating layer surface opposite that of said base material.

17. An image processing method according to claim 16, further comprising the step of removing a sheet being releasably attached to a pressure-sensitive adhesive layer which is provided on the back of said base sheet resulting in the pressure-sensitive adhesive remaining on the back of the base sheet.

18. An image processing method according to claim 15, wherein said film layer is releasably attached to said base material surface opposite that of said thermoexpansive coating layer.

* * * * *